US007963291B2

(12) United States Patent
Tojo et al.

(10) Patent No.: US 7,963,291 B2
(45) Date of Patent: Jun. 21, 2011

(54) HAIR HOLDER

(75) Inventors: Takehiko Tojo, Tochigi (JP); Hideo Kobayashi, Tochigi (JP)

(73) Assignee: Kao Corporation, Tokyo (JP)

( * ) Notice: Subject to any disclaimer, the term of this patent is extended or adjusted under 35 U.S.C. 154(b) by 1425 days.

(21) Appl. No.: 10/562,977

(22) PCT Filed: Feb. 3, 2005

(86) PCT No.: PCT/JP2005/001578
§ 371 (c)(1),
(2), (4) Date: Dec. 29, 2005

(87) PCT Pub. No.: WO2005/074742
PCT Pub. Date: Aug. 18, 2005

(65) Prior Publication Data

US 2007/0065489 A1 Mar. 22, 2007

(30) Foreign Application Priority Data

Feb. 9, 2004 (JP) ..... 2004-031633
Feb. 9, 2004 (JP) ..... 2004-031634

(51) Int. Cl.
*A45D 2/00* (2006.01)

(52) U.S. Cl. ..... 132/222

(58) Field of Classification Search ..... 132/222, 132/270
See application file for complete search history.

(56) References Cited

U.S. PATENT DOCUMENTS

| | | | | |
|---|---|---|---|---|
| 3,255,765 | A * | 6/1966 | Sturdivant | 132/223 |
| 4,470,423 | A | 9/1984 | Wajaroff | |
| 5,021,050 | A * | 6/1991 | Iskra | 604/379 |
| 7,305,995 | B2 * | 12/2007 | Tojo et al. | 132/222 |
| 7,543,591 | B1 * | 6/2009 | Munsil | 132/270 |
| 2004/0231689 | A1 | 11/2004 | Kobayashi et al. | |

FOREIGN PATENT DOCUMENTS

| | | |
|---|---|---|
| DE | 19 11 176 | 9/1970 |
| FR | 2 397 803 | 2/1979 |
| GB | 207948 | 12/1923 |
| JP | 30-10656 | 7/1955 |
| JP | 45-34118 | 11/1970 |
| JP | 61-148203 | 9/1986 |
| JP | 1-69403 | 5/1989 |
| JP | 10-42934 | 2/1998 |
| JP | 10-117836 | 5/1998 |
| JP | 10-192036 | 7/1998 |

(Continued)

OTHER PUBLICATIONS

U.S. Appl. No. 10/560,044, filed Dec. 8, 2005, Tojo et al.

*Primary Examiner* — Robyn Doan
(74) *Attorney, Agent, or Firm* — Oblon, Spivak, McClelland, Maier & Neustadt, L.L.P.

(57) ABSTRACT

A hair holder (1) composed of two hair holding sheets (3) for holding a hair bundle in a prescribed shape. The hair holding sheet (3) is an agent-impregnated sheet (3*a*) having a Taber stiffness of 0.2 mN·m or higher and a water retention of 0.03 g/cm$^2$ or more and impregnated with a hair treating agent. Two agent-impregnated sheets (3*a*) are joined together to make a flat tube (1A) having an opening at each end thereof and a hollow (12) through which a hair bundle is to be inserted.

20 Claims, 10 Drawing Sheets

FOREIGN PATENT DOCUMENTS

| | | |
|---|---|---|
| JP | 11-127942 | 5/1999 |
| JP | 2002-47152 | 2/2002 |
| JP | 2002-95522 | 4/2002 |
| JP | 2002-325619 | 11/2002 |
| JP | 2003-93133 | 4/2003 |
| JP | 2003-530929 | 10/2003 |
| JP | 2003-319814 | 11/2003 |
| JP | 2003-319815 | 11/2003 |
| JP | 2004-531322 | 10/2004 |
| WO | 03/007752 | 1/2003 |

* cited by examiner

HAIR HOLDER

TECHNICAL FIELD

The present invention relates to a hair holder used as a tool for rolling a hair bundle into a prescribed shape in curling hair by, for example, permanent waving.

The present invention also relates to a hair holder used as a tool for maintaining a hair bundle in a prescribed shape and a method of treating hair using the hair holder.

BACKGROUND ART

A cold permanent waving tool illustrated in JP-A-U-30-10656 is known as a hair holder used in curling hair by permanent waving. The hair holder comprises a pair of half cylinders and an impregnatable member made of a sponge-like absorbent material provided on the inner side of each of the half cylinders. A hair bundle wound onto a perm rod is fitted in the inside of the cylinders, and the impregnatable members are impregnated with a permanent waving solution. The permanent waving solution is prevented from leaking outside.

Recently, hair holders which enable easy handling to a hair bundle without using a rod have been proposed. For example, JP-A-10-192036 discloses a hair holder having a tube. After a hair bundle is inserted through the tube, the tube is deformed, and the rolled state of the hair bundle is maintained.

The problem of this hair holder, however, is that the hair holder must be rolled up by the hand, and the rolling up operation is troublesome. To solve the problem, JP-A-2003-93133 and WO 03/007752 propose a hair holder having a tube on which a curling thread is wound helically. With a hair bundle inserted in the tube, the curling thread is pulled to roll up the hair bundle together with the tube.

JP-A-11-127942 discloses a hair coloring tool having half cylinders in which hair is placed. The half cylinders each have felt impregnated with an agent.

DISCLOSURE OF THE INVENTION

With regard to a hair holder of the type that a hair bundle inserted therein and rolled up, it is desirable that a sufficient amount of a hair treating agent is retained in the hair holder, supplied to the hair bundle without leakage from the hair holder during a hair treatment.

However, in the case of the hair holder of JP-A-2003-93133, for example, a hair treating agent applied to the tube which is rolled up with a hair bundle leaks out the hair holder and a necessary amount of the hair treating agent is not retained in the hair holder because the hair treating agent is supplied through the nonwoven fabric forming the sides of the tube. It is problematical, in particular, that a hair treating agent is not uniformly supplied to a rolled hair bundle. This problem is particularly conspicuous when a quantity of a hair treating agent should be supplied to a hair bundle.

It is also desirable that a hair treating agent be applied only to the portion of hair that is to be treated (i.e., the hair bundle held in a hair holder). In this connection, a desirable hair holder will prevent a hair treating agent from being applied to a part of the hair that should be left untreated and from soiling the clothing and will enable re-inserting a hair bundle.

Accordingly, an object of the present invention is to provide a hair holder which has a hair treating agent integrated with a constituent sheet so that the amount of the hair treating agent necessary for a hair treatment is securely retained without leaks and thereby uniformly supplied the hair treating agent to a rolled hair bundle.

Another object of the present invention is to provide a hair holder in which a hair treating agent is present on a sheet without being localized so that it can be supplied uniformly to a hair bundle.

Still another object of the present invention is to provide a hair holder and a hair treating method using the hair holder. The hair holder has a hair treating agent integrated with a constituent sheet so that the amount of the hair treating agent necessary for a hair treatment is securely retained without leaks and thereby uniformly supplied to a rolled up hair bundle. The hair holder is designed to apply the hair treating agent only to the portion of the hair that is to be treated without applying the hair treating agent to the portion of hair that is not to be treated nor soiling the clothing and the skin of an operator or an operatee with the hair treating agent. The hair holder enables re-inserting a hair bundle therethrough.

The present inventors have found the following (first findings). Where a sheet having a hair treating agent integrated therewith so that the hair treating agent may not leak or ooze out, particularly a sheet having a specific Taber stiffness and a specific water retention and having been impregnated with the hair treating agent is used as a hair holding sheet, the hair treating agent is not allowed to leak out prior to the sheet rolling and the hair holding sheet is capable of supplying a hair bundle with the amount of the hair treating agent necessary to treat the hair bundle.

The first findings are based on the following principle. When a nonwoven fabric sheet having at least a certain stiffness is used as a hair holding sheet, the network structure of the nonwoven fabric is hardly deformed even while it is in a hair treating process. The hair treating agent caught by such a network structure hardly oozes out of the hair holding sheet. Moreover, when the hair holding sheet has at least a certain water retention, the water holding ability, the capillary force and the diffusive force exerted between the hair holding sheet and a hair bundle interact to result smooth migration of the hair treating agent to the hair bundle.

Having been reached based on the first findings, the present invention accomplishes the above object by providing a hair holder composed of one or more hair holding sheets for holding a hair bundle in a prescribed shape. At least one of the hair holding sheets retains a hair treating agent thereby having the hair treating agent integrated therewith. Preferably, the hair holder is composed of one or more hair holding sheets for holding a hair bundle in a prescribed shape, at least one of the hair holding sheets having a Taber stiffness of 0.2 mN·m or higher and a water retention of 0.03 g/cm$^2$ or more and impregnated with the hair treating agent.

The expression "not leak (or not ooze out)" as used throughout the description of the present invention means that, when application of the hair treating agent to a hair bundle is not demanded, the hair treating agent does not at all leak or ooze out or, if it does, the amount of leakage or oozing is very small.

The terminology "Taber stiffness" as used herein represents a stiffness of a sheet specified in JIS P8125, which is the force required to bend a sheet at a given angle as measured with a Taber stiffness tester. The terminology "water retention" as used herein means the amount of a hair treating agent (used to carry out an intended hair treatment) that can be retained by nonwoven fabric.

The sheet constituting the hair holding sheet preferably has a Taber stiffness of 0.2 to 20 mN·m. With the Taber stiffness being in that range, leakage of the hair treating agent is prevented even when the hair holding sheet is rolled up, and the hair holding sheet has improved rolling operationality and improved capability of holding a hair bundle in shape.

The sheet preferably has a water retention of 0.03 to 0.7 g/cm$^2$. With the water retention falling in that range, the hair treating agent smoothly migrates to the hair bundle to accomplish the hair treatment sufficiently.

The materials that can be used as the hair holding sheet include nonwoven fabrics, woven fabrics, and other materials capable of retaining a hair treating agent. Nonwoven fabrics are preferred in terms of water retention, flexibility, and productivity.

The present inventors have also found the following (second findings). Where a sheet impermeable to the hair treating agent and applied by a highly viscous hair treating agent is used as a hair holding sheet, the hair treating agent is kept in the applied state without being localized on the sheet even when the holding sheet is deformed by rolling up.

Having been completed based on the second findings, the present invention accomplishes the above object by providing a hair holder composed of one or more hair holding sheets for holding a hair bundle in a prescribed shape and at least one of the hair holding sheets has a hair treating agent having a viscosity of 100 mPa·s or higher applied to the inner side thereof and is impermeable to the hair treating agent.

The applied layer of the hair treating agent includes an agent supporting layer for supporting the hair treating agent.

The present inventors have also found the following (third findings). Where sealed agent packets containing a hair treating agent are provided on one side of a sheet to compose a hair holding sheet, the hair holding sheet prevents leakage of the hair treating agent when it is not in use for a hair treatment. When it is used for a hair treatment, the hair holding sheet uniformly supplies the amount of the hair treating agent required for the hair treatment to a hair bundle.

Having been completed based on the third findings, the present invention accomplishes the above object by providing a hair holder composed of one or more hair holding sheets for holding a hair bundle in a prescribed shape. At least one of the hair holding sheets has a plurality of sealed agent packets containing a hair treating agent provided on one side thereof.

The present invention also provides a hair treating method including rolling up a hair bundle using the hair holder to carry out a hair treatment. After a hair bundle is placed on or inserted through the hair holder and, when the hair treatment is to be started, pressure is applied to the sealed agent packets to break the packets, the hair treating agent is released from the packets and supplied to the hair bundle.

The term "rolling up" as used throughout the description of the invention means "setting" hair in a desired style, including not only "rolling up" in the narrow sense of the word but spirally curling, bending in a zig-zag form, and the like.

BRIEF DESCRIPTION OF THE DRAWINGS

FIG. 1(*b*) is a cross-section on line A-A of FIG. 1(*a*).

FIG. 4(*b*) is a cross-section on line A-A of FIG. 4(*a*).

FIG. 5(*b*) is a cross-section on line B-B of FIG. 4(*a*), showing a protective sheet being drawn.

FIG. 5(*c*) is a cross-section on line B-B of FIG. 4(*a*), showing the hair bundle having been inserted.

FIG. 8(*b*) is a cross-section on line B-B of FIG. 8(*a*).

FIG. 10(*b*) is a perspective view of the hair holder of FIG. 8(*a*), illustrating the procedure of rolling up a hair bundle in the mode of use.

FIG. 10(*c*) is a perspective view of the hair holder of FIG. 8(*a*), illustrating the procedure of rolling up a hair bundle in the mode of use.

FIG. 10(*d*) is a perspective view of the hair holder of FIG. 8(*a*), illustrating the procedure of rolling up a hair bundle in the mode of use.

FIG. 11(*b*) is a cross-section on line B-B of FIG. 11(*a*).

DETAILED DESCRIPTION OF THE INVENTION

A preferred embodiment (first embodiment) of a hair holder according to the present invention will be described in detail with reference to the accompanying drawings.

Figure 1A:
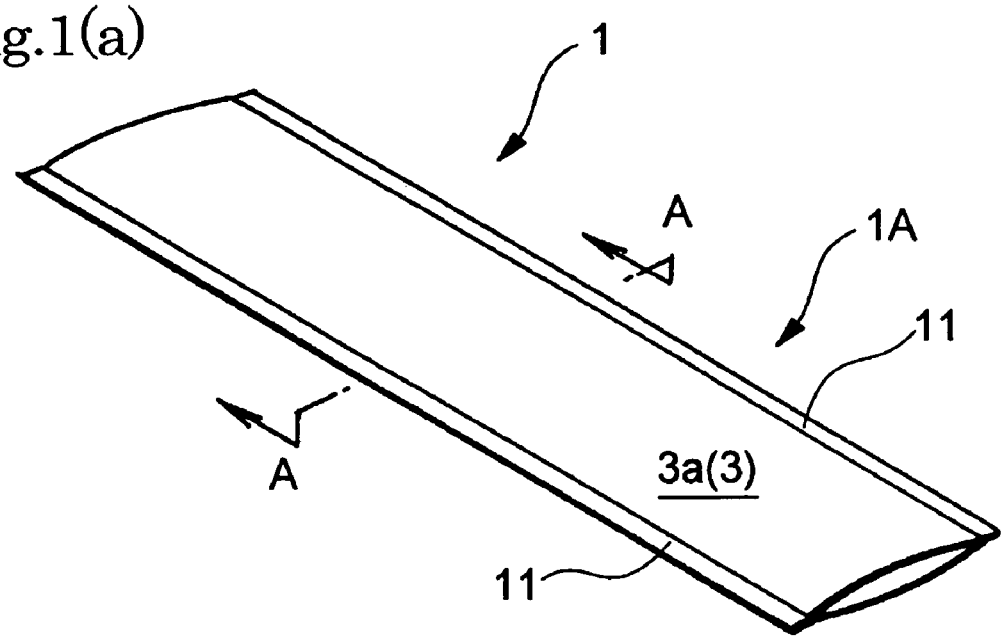
FIG. 1(*a*) is a perspective schematic view of the structure of a hair holder according to a first embodiment.
Figure 1B:
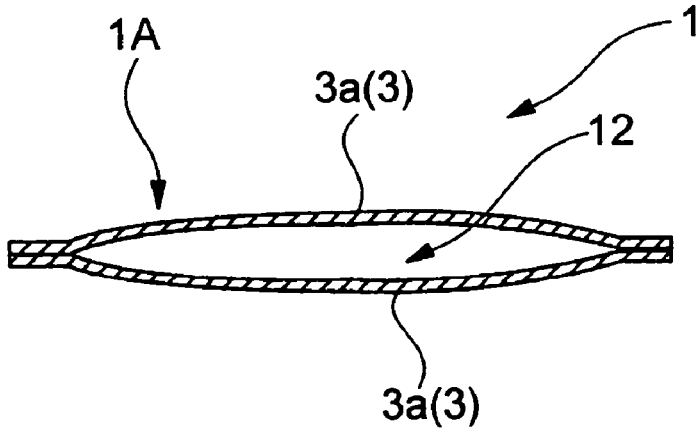

As illustrated in FIGS. 1(*a*) and 1(*b*), a hair holder 1 of the first embodiment is composed of two hair-holding sheets 3 which hold a hair bundle with a prescribed shape. The hair holding sheets 3 are agent-impregnated sheet 3*a* formed of a nonwoven fabric having a Taber stiffness of 0.2 mN·m or more and a water retention of 0.03 g/cm$^2$ or more impregnated with a hair treating agent.

The structure of the hair holder 1 according to the first embodiment will be described concretely.

As shown in FIGS. 1(*a*) and 1(*b*), the hair holder 1 is a flat tube 1A formed of agent impregnated two sheets 3*a* joined together along their both side edges 11 by heat sealing. The flat tube 1A has openings at both ends thereof and a hollow 12 through which a hair bundle is inserted. The flat tube 1A is rolled up together with a hair bundle inside the hollow 12 by, for example, pulling a thread attached to the flat tube 1A. Alternatively, the flat tube 1A, with the hair bundle in, curls up due to its own spring action. The hair bundle is thus held in a prescribed shape.

In the first embodiment, nonwoven fabric having a specific Taber stiffness and water retention is used to make the agent impregnated sheets 3*a* in order to retain a sufficient amount of a hair treating agent for conducting an intended hair treatment without allowing leakage to the outside not only in its stretched out state but in the rolled up state.

The Taber stiffness of the nonwoven fabric preferably ranges from 0.2 to 20 mN·m. As long as the Taber stiffness falls within that range, the hair holder 1 of the first embodiment not only prevents a leak of a hair treating agent but exhibits improved rolling operationality and improved capability of holding a hair bundle in shape.

The Taber stiffness varies depending on various factors including the thickness, weight per unit area and raw material (fiber) of the sheet and additives to the sheet. Examples of materials preferably used to achieve the above-recited range of Taber stiffness include polypropylene, polyethylene terephthalate, nylon resins, polyethylene, and composites of these materials.

The water retention of the nonwoven fabric is preferably more than 0.03 and less than 0.7 g/cm$^2$. With the water retention falling within that range, the hair treating agent smoothly migrates to the hair bundle to ensure sufficient hair treatment.

The water retention varies depending on various factors including hydrophilic properties of the fibers constituting the sheet, the shape and size of the network structure of the fibers, and the thickness of the sheet. Examples of materials preferably used to achieve the above-recited water retention include polyethylene, polypropylene, polyethylene terephthalate, rayon, and nylon. Examples of materials preferred for achieving both the above-recited Taber stiffness and water retention are polypropylene, polyethylene terephthalate, and nylon.

In the present embodiment, a spun-bonded nonwoven fabric made of polyethylene terephthalate fiber is used to achieve Taber stiffness and water retention falling within the above-recited respective ranges. The nonwoven fabric has a thickness of 0.54 mm and a weight of 250 g/m$^2$.

The proper amount of the hair treating agent to be infiltrated into the nonwoven fabric is 0.03 to 0.7 g/mm$^2$ in view of achievement of the intended hair treatment.

The hair treating agent is not particularly limited as long as it is commonly used for hair treatments. Examples of the hair treating agent include a permanent waving solution (one pack type), a hair-care preparation, a hair styling preparation, and a hair dye. To accelerate migration of the hair treating agent by capillarity or diffusion, the viscosity of the hair treating agent is preferably as low as possible, specifically 200 mPa·s or lower.

A mode of use of the hair holder 1 according to the first embodiment is illustrated below.

A hair bundle (not shown) is inserted into the hollow 12 of the flat tube 1A. A hair inserter (not shown) may be used to introduce the hair bundle into the hollow 12. The flat tube 1A with the hair bundle in is rolled up. In the rolling up, a stress is imposed to the impregnated sheets 3*a* to cause the hair treating agent to ooze out and be supplied to the hair bundle. The above each treatment is carried out on the hair bundle inserted in the hollow 12. The hair bundle with the hair treating agent applied thereto is left to stand for a predetermined time, e.g., about 15 minutes, meanwhile the hair treating agent is distributed throughout the hair bundle uniformly.

After the hair bundle is rinsed briefly, it is further left to stand for an additional predetermined time, e.g., about 15 minutes. The hair bundle is then freed from the hair holder 1 and rinsed thoroughly.

As described, since the hair holding sheets 3 which is composed of a nonwoven fabric having a specific Taper stiffness and water retention and impregnated with a hair treating agent, i.e., the agent impregnated sheets 3*a* is used as the hair holder 1, deformation of the network structure of the nonwoven fabric is restrained when the hair holding sheets 3 are rolled up. As a result, leakage of the hair treating agent from the hair holding sheets 3 is prevented, and the amount of the hair treating agent required for a hair treatment can be retained in the hair holding sheets 3. Thus, the hair treating agent smoothly migrates to the hair bundle and evenly supplied to the hair bundle.

Another embodiment (second embodiment) of the hair holder according to the present invention is then described with reference to the accompanying drawing.

Figure 2:
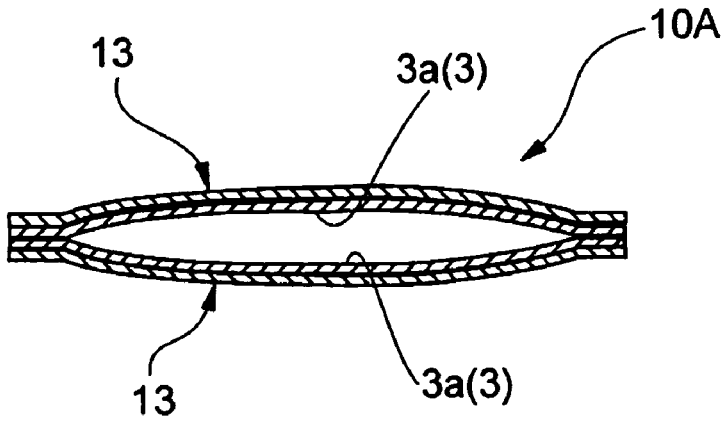
FIG. 2 is a schematic cross-section of a hair holder according to a second embodiment.

As illustrated in FIG. 2, the hair holder 10A of the second embodiment is a flat tube 10A which is comprised of the flat tube 1A of the first embodiment and an agent-impermeable layer 13 made of a material impermeable to a hair treating agent. The agent-impermeable layer 13 is formed on part of, or the whole of, the outer surface of the flat tube 1A.

The agent impermeable layer 13 prevents a hair treating agent from oozing from the outer surface of the flat tube 10A thereby preventing the hair treating agent from adhering to the operator's or operatee's clothing or skin. In view of that function, the agent impermeable layer 13 is preferably provided on the entire surface of the flat tube 10A but may be provided on a part of the flat tube 10A. For instance, in case where the flat tube 10A is of the type that curls up by its own spring action, the agent impermeable layer 13 may be formed only on the side of the flat tube 10A which will be the outer periphery of the roll and will be touched by an operator. By this configuration, the hair treating agent is prevented from leaking from that side, and the operator's hand is protected from the hair treating agent when the operator touches that side.

Materials to form the agent impermeable layer 13 are polyethylene, polypropylene, polyethylene terephthalate, and the like which are employed to form conventional films.

The other structural factors, action and effect of the second embodiment are the same as in the first embodiment.

Another embodiment (third embodiment) of the hair holder according to the present invention is then described by way of the accompanying drawing.

Figure 3:
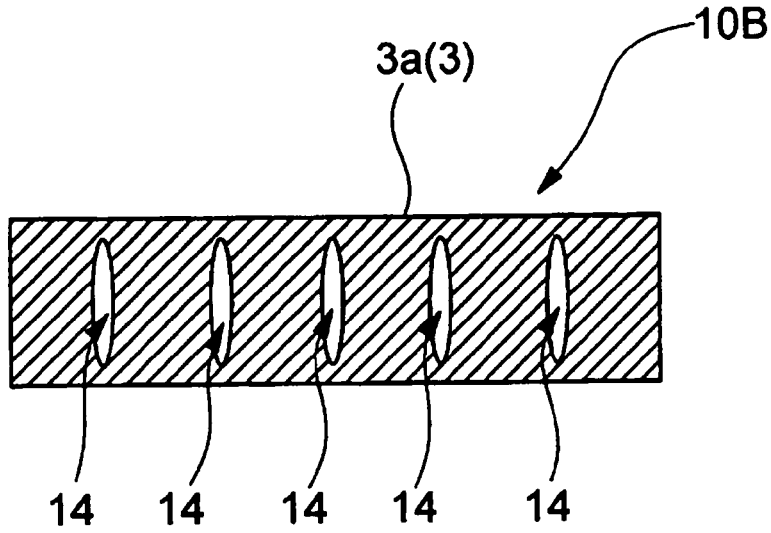
FIG. 3 is a schematic plan view of a hair holder according to a third embodiment.

As illustrated in FIG. 3, a hair holder 10B of the third embodiment is an article of sheet shape, formed of a single agent-impregnated sheet 3*a*. A plurality of holes 14 through which a hair bundle is threaded is provided in the agent impregnated sheet 3*a* with a prescribed interval. A hair bundle is threaded through the holes 14 in a zigzag form, and the hair holder 10B is then rolled up together with the hair bundle.

The hair holder 10B of the third embodiment is particularly useful in applications where adhesion of a hair treating agent to an operator or an operatee is not so problematical, for example, in hair treating with a hair-care preparation. The hair holder can be composed solely of a sheet material having a spring effect.

The other structural factors, action and effect of the third embodiment are the same as in the first embodiment.

The present invention is not limited to the above-described first to third embodiments, and modifications may be made therein.

The nonwoven fabric having a specific Taber stiffness and water retention that is used in the first to the third embodiments does not always need to be previously impregnated with a hair treating agent. It may be impregnated with a hair treating agent immediately before performing a hair treatment to become the "agent-impregnated sheet(s)" as referred to in the first to the third embodiments. In that case, chemical resistance of the nonwoven fabric is not so important, and it is not necessary to worry about evaporation of the hair treating agent from the hair holder.

With regard to the agent impregnated sheet 3*a* of the third embodiment, the agent impermeable layer 13 may be provided on only a part of the agent impregnated sheet 3*a* where a hair bundle does not contact and an operator's hand touches.

The fourth embodiment of the hair holder according to the present invention will be described with reference to the accompanying drawings.

Figure 4A:
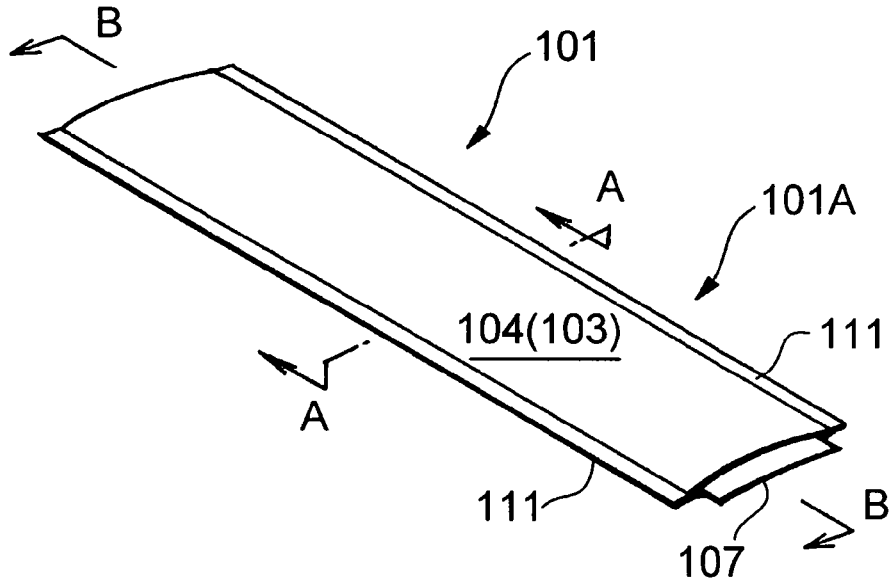
FIG. 4(*a*) is a perspective schematic view of the structure of a hair holder according to a fourth embodiment.
Figure 4B:
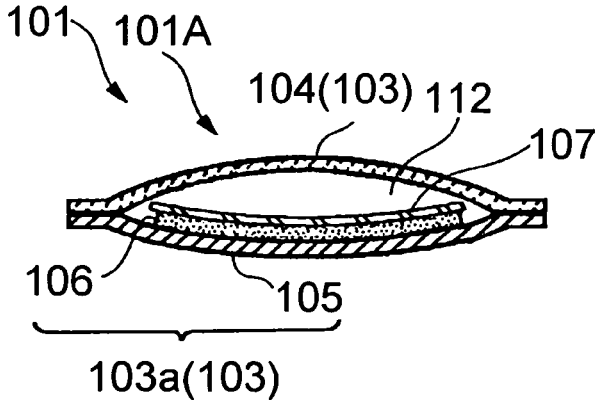

As illustrated in FIGS. 4(*a*), 4(*b*), 5(*a*), and 5(*b*), a hair holder 101 of the fourth embodiment is composed of two hair holding sheets 103 for holding a hair bundle 109 in a prescribed shape. One of the hair holding sheets 103 is an agent-coated sheet 103*a* which is impermeable to a hair treating agent and coated on its inner side with a hair treating agent having a viscosity of 100 mPa·s or higher.

The following is the structure of the hair holder 101 of the fourth embodiment.

As illustrated in FIGS. 4(*a*) and 4(*b*), the other hair holding sheet 103 is an agent permeable sheet 104. The agent coated sheet 103*a* and the agent permeable sheet 104 are heat sealed along their both side edges 111 to form the hair holder 101, which is a flat tube 101A having an opening at each end thereof through which a hair bundle can be inserted.

A protective sheet 107 is inserted through the flat tube 101A with its end sticking out of the opening.

The agent coated sheet 103*a*, the agent permeable sheet 104, and the protective sheet 107 are described below.

The agent coated sheet 103*a* is composed of a resin film 105 and an agent coating layer 106. The resin film 105, being impermeable to a hair treating agent, prevents a hair treating agent from oozing and serves as a base of the agent coated sheet 103*a*.

A layer to which a hair treating agent evenly applied is the agent coating layer 106 located inside of the resin film 105. The agent coating layer 106 is supported by an agent supporting layer such as loose nonwoven fabric or sponge. The agent coating layer 106 does not flow because the hair treating agent is highly viscous. Such an agent coating layer 106 is obtained by applying a hair treating agent onto the surface of the agent supporting layer. The hair treating agent is thus integrated with the agent supporting layer.

The hair treating agent is not particularly limited as long as it is commonly used for hair treatments. Examples of the hair treating agent include a permanent waving solution (one pack type), a hair-care preparation, a hair styling preparation, and a hair dye. To minimize flow of the hair treating agent on the resin film 105, the viscosity of the hair treating agent is preferably 100 mPa·s or more. To accelerate migration of the hair treating agent to a hair, the viscosity of the hair treating agent is preferably 10000 mPa·s or lower.

The agent permeable sheet 104 faces the agent coating layer 106 of the agent coated sheet 103*a* via the protective sheet 107. The agent permeable sheet 104 is a nonwoven fabric that is permeable to the hair treating agent and allows the hair treating agent to pass to the hair bundle 109. The nonwoven fabric includes polyethylene nonwoven fabric.

The protective sheet 107 is interposed between the agent coated sheet 103*a* and the agent permeable sheet 104. The protective sheet 107 is a resin film impermeable to the hair treating agent so that it serves to cover the agent coating layer 106 on its side facing the agent coated sheet 103*a* and to form a hollow 112 (see FIGS. 4(*b*) and 5(*a*)) on its side facing the agent permeable sheet 104, through the hollow 112 the hair bundle 109 is to be inserted. The resin film includes polyethylene, polypropylene, polyethylene terephthalate, and the like.

The protective sheet 107 preferably has its surface treated with a release agent so as to minimize adhesion of the hair treating agent to the flat tube 101A when the protective sheet is drawn out of the flat tube 101A.

Usage of the hair holder 101 of the fourth embodiment is illustrated below.

Figure 5A:
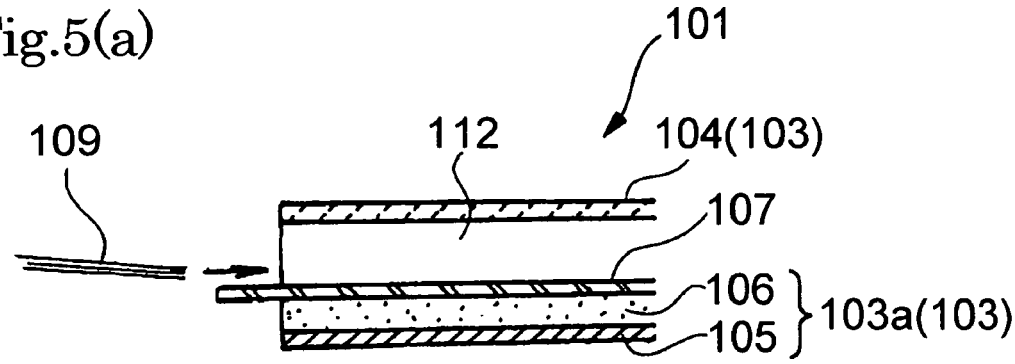
FIG. 5(*a*) is a cross-section on line B-B of FIG. 4(*a*), showing a hair bundle being about to be inserted.
Figure 5B:
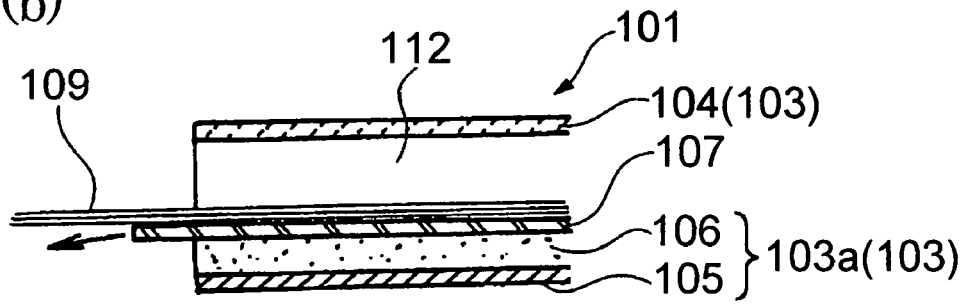
Figure 5C:
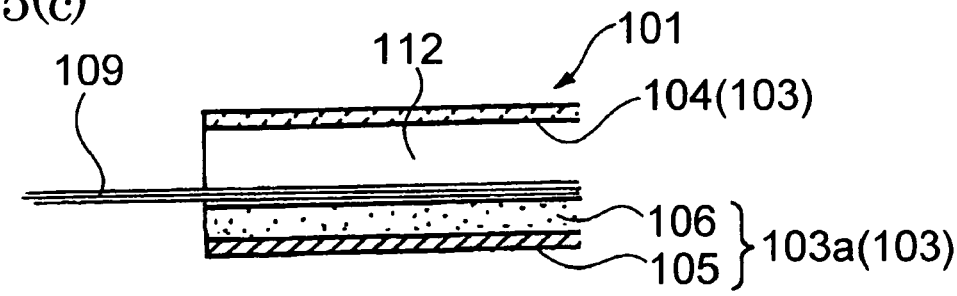

As illustrated in FIG. 5(*a*), a hair bundle 109 is inserted through the hollow 112 defined between the agent permeable sheet 104 and the protective sheet 107. The hair bundle 109 may be led into the hollow 112 with the aid of a hair inserter 113 (see FIG. 7, described later in detail).

As shown in FIGS. 5(*b*) and 5(*c*), the protective sheet 107 is pulled out of the flat tube 101A. The hair bundle 109 is thus placed on the agent coating layer 106 of the agent coated sheet 103*a*. The flat tube 101A is then rolled up together with the hair bundle 109. In that state, the flat tube 101A is left to stand for a predetermined time, e.g., about 15 minutes, meanwhile the hair treating agent is spread over the hair bundle 109 uniformly.

After the hair bundle 109 is rinsed briefly, it is further left to stand for an additional predetermined time, e.g., about 15 minutes. The hair bundle 109 is then freed from the hair holder 101 and rinsed thoroughly.

As stated above, one of the hair holding sheets 103 of the fourth embodiment is an impermeable sheet having a high-viscosity hair treating agent applied thereto. Therefore, when the agent coated sheet 103*a* is deformed by rolling, the hair treating agent is maintained in its applied state and is uniformly supplied to the hair bundle 109.

According to the fourth embodiment in particular, the hair treating agent is integrated with the agent supporting layer to provide the agent coating layer. The hair treating agent hardly flows because of its high viscosity and being supported, thereby the uniform distribution of the hair treating agent in the hair bundle is further improved.

According to the fourth embodiment, the protective sheet 107 interposed between the agent coated sheet 103*a* and the agent permeable sheet 104 prevents the hair treating agent of the agent coated sheet 103*a* from oozing from the agent permeable sheet 104 and also prevents the hair treating agent supplied to the hair bundle 109 from adhering the clothing of the operator, etc. when the hair bundle 109 is inserted through the flat tube 101A.

Still another embodiment (fifth embodiment) of the hair holder according to the present invention will be described by way of the accompanying drawings.

Figure 6:
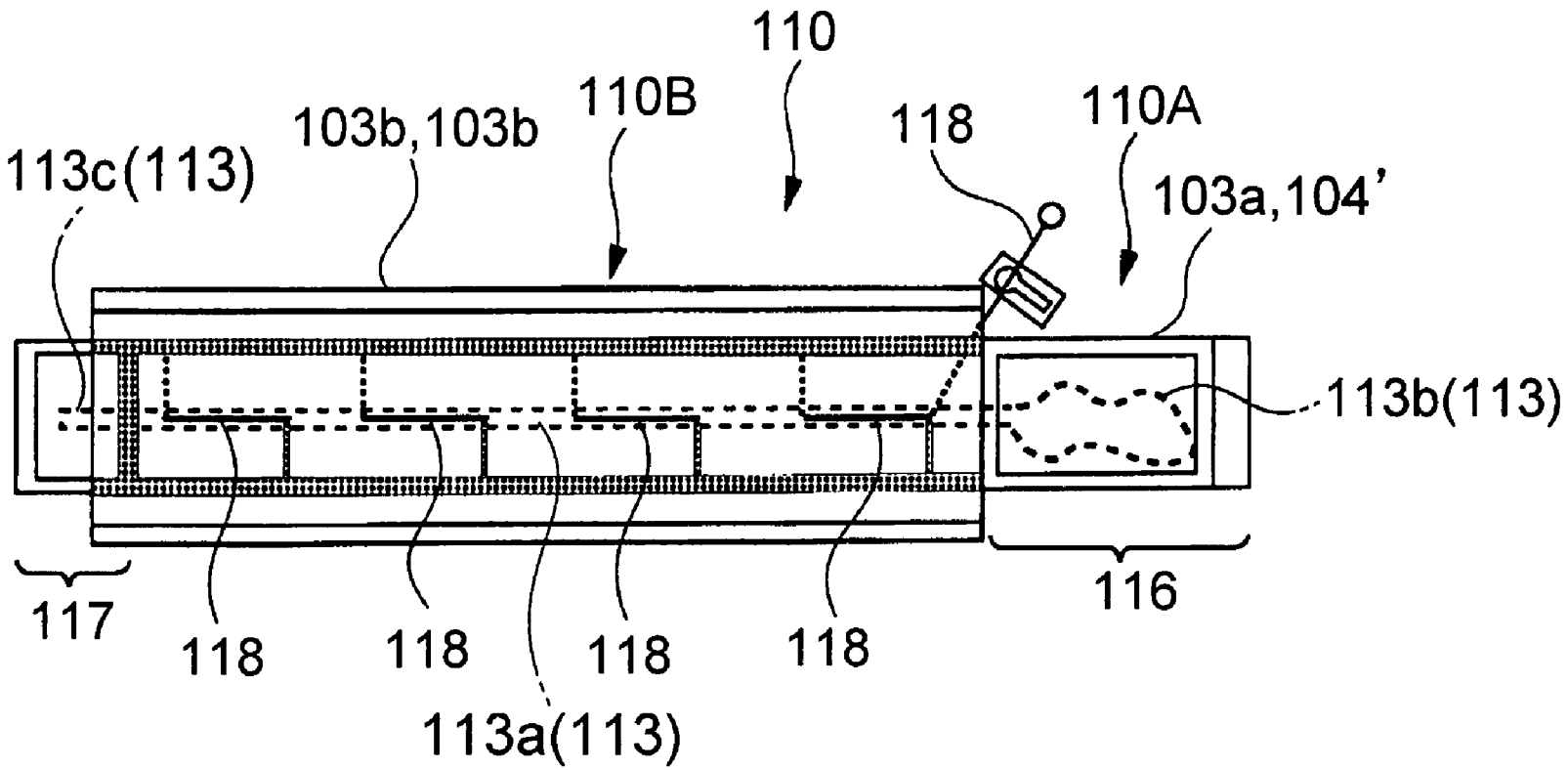
FIG. 6 is a schematic view of a hair holder according to a fifth embodiment.

As illustrated in FIG. 6, a hair holder 110 of the fifth embodiment is composed of an inner flat tube 110A and an outer flat tube 110B. The inner flat tube 110A is a tube through which a hair bundle is inserted, and the outer flat tube 110B is a tube through which the inner flat tube 110A is inserted.

The inner flat tube 110A is obtained by superposing an agent coated sheet 103*a* and an agent impermeable sheet 104'. The outer flat tube 110B is obtained by superposing two sheets of nonwoven fabric 103*b* permeable to a hair treating agent.

Figure 7:
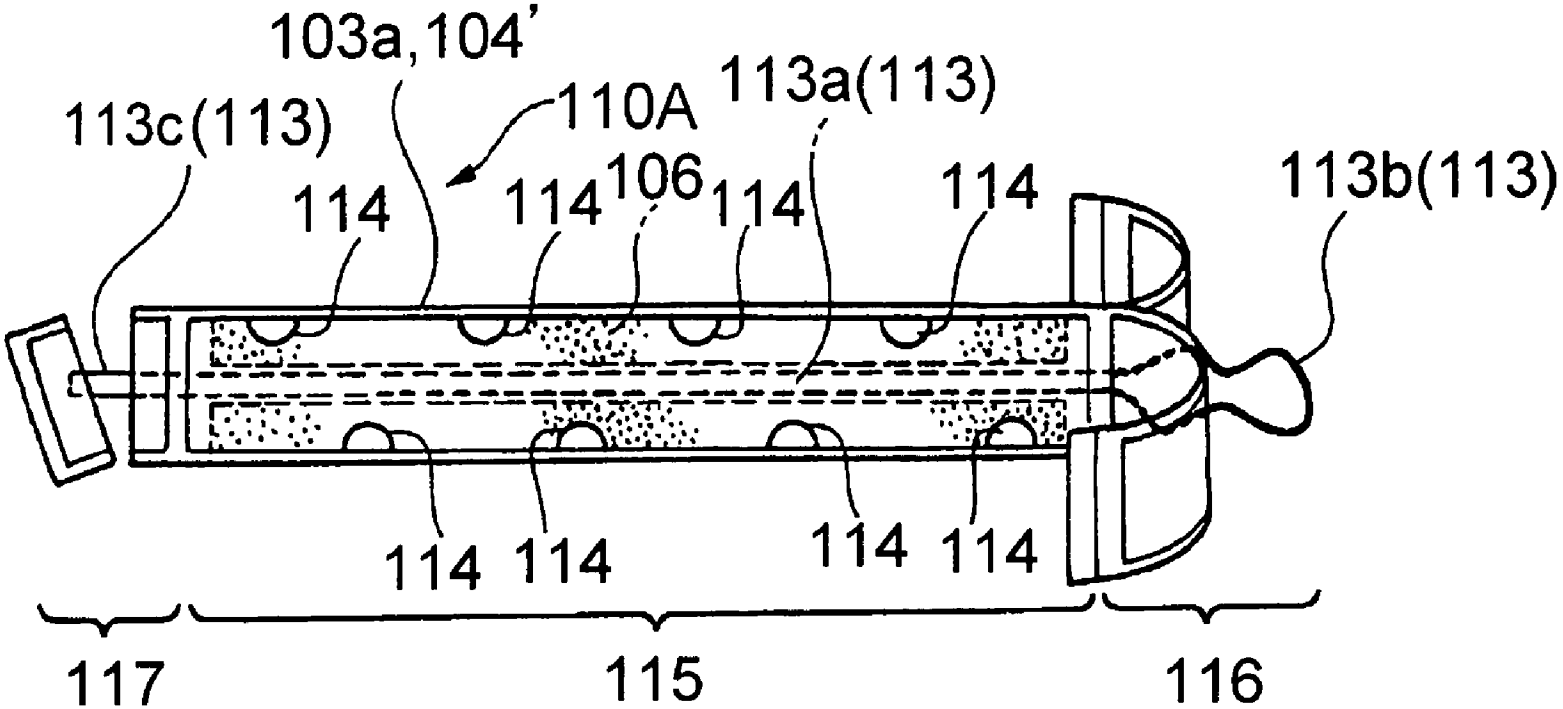
FIG. 7 is a perspective schematic view of an inner flat tube of the hair holder according to the fifth embodiment.

As illustrated in FIG. 7, the inner flat tube 110A has the shape of a bag, formed by superposing the agent coated sheet 103*a* and the agent impermeable sheet 104' and heat sealing the two sheets along their perimeter. The bag, i.e., the inner flat tube 110A, is filled with a hair treating agent and does not allow the hair treating agent to ooze out.

A hair inserter 113 is inserted in the inner flat tube 110A. The hair inserter 113 has a leading stick 113*a* and a loop 113*b* at the tip of the leading stick 113*a*. The loop 113*b* is used to catch up hairs to make a hair bundle.

The heat sealed region of the inner flat tube 110A is described in more detail. The heat sealed region is divided into two or more portions according to the shape of the hair inserter 113. It is divided into a first sealed portion 115 where the most part of the leading stick 113*a* and a hair treating agent are hemmed in, a second sealed portion 116 where the loop 113*b* is hemmed in, and a third sealed portion 117 where the leading end 113*c* of the leading stick 113*a* is hemmed in.

The seal on each side of the first sealed portion 115 has projections 114 projecting to the widthwise middle of the inner flat tube 110A. The projections 114 on one side and those on the other side alternate with each other. The projections 114 are provided for the purpose of smoothly supplying the hair treating agent to a hair bundle 109 when the hair bundle 109 is being inserted through the inner flat tube 110A.

In the second sealed portion 116, the bonding strength of the heat seal is controlled so that the two sheets may be separated apart by ordinary peeling operation in order that the loop 113*b* may be exposed easily before drawing the hair inserter 113.

The resin films 103*a* and 104' forming at least the third sealed portion 117 are made of material that can be torn off by ordinary tearing operation in order that the leading end 113*c* of the leading stick 113*a* may be exposed easily before drawing the hair inserter 113.

The two sheets of nonwoven fabric 103*b* superposed on each other are heat sealed along both sides to form the outer flat tube 110B. The inner flat tube 110A is inserted through the outer flat tube 110B. The outer flat tube 110B is wider than the inner flat tube 110A. The outer flat tube 110B is shorter than the inserted inner flat tube 110A so that the tailing end of the second sealed portion 116 and the leading end of the third sealed portion 117 of the inner flat tube 110A stick out of the outer flat tube 110B.

The outer flat tube 110B has a curling thread 118 for maintaining a hair bundle 109 in a prescribed shape. In this embodiment, the curling thread 118 is wound around the outer periphery of the inner flat tube 110A.

Usage of the hair holder 110 according to the fifth embodiment will be described.

As illustrated in FIGS. 6 and 7, the heat sealed portion at one end of the inner flat tube 110A is separated apart to expose the loop 113*b*, and the other end of the inner flat tube 110A is torn off to expose the leading end 113*c* of the leading stick 113*a*. After a hair bundle 109 is passed through the loop 113*a*, the hair inserter 113 is drawn out of the inner flat tube 110A by pulling the leading end 113*c* of the leading stick 113*a* with fingers. As a result, the hair bundle 109 is successfully inserted through the inner flat tube 110A, and the hair treating agent is thus supplied to the hair bundle 109.

The inner flat tube 110A is then drawn out from the outer flat tube 110B. The curling thread 118 is pulled to roll up the outer flat tube 110B. Depending on the kind of the hair treating agent, the inner flat tube 110A is not drawn and is rolled up together with the outer flat tube 110B and the hair bundle 109. After these handlings, the hair bundle 109 is treated in the same manner as in the fourth embodiment.

According to the fifth embodiment, since the hair treating agent is sealed in the inner flat tube 110A, uniform supply of the hair treating agent to the hair bundle 109 and prevention of hair treating agent leakage from the inner flat tube 110A in rolling the hair bundle 109 can be accomplished more securely.

Since the loop 113*b* and the leading end 113*c* of its leading stick 113*a* of the hair inserter 113 can be exposed, smooth insertion of the hair bundle 109 into the inner flat tube 110A is attainable.

The present invention is not limited to the above-mentioned fourth and fifth embodiments, and various modifications can be made therein.

To restrain the hair treating agent from flowing, the hair treating agent is preferably supported by an agent supporting layer as in the fourth embodiment, or a hair treating agent having an increased viscosity may be applied directly to the impermeable sheet.

The flat tube of the fourth embodiment and the inner flat tube of the fifth embodiment may be composed of two agent coated sheets. In this case, the hair bundle is sandwiched between two uniform hair treating agent layers of the agent coated sheets and it is advantageous to supply the hair bundle with the hair treating agent more smoothly.

While in the fourth and the fifth embodiments the agent coated sheet is a resin film previously having a hair treating agent applied thereto, the hair treating agent may be applied to the resin film to make an agent coated sheet immediately before conducting hair treatment. This modification is advantageous for preventing evaporation of the hair treating agent.

The agent coated sheet may be one prepared by applying a high viscous hair treating agent to nonwoven fabric having a Taber stiffness of 0.2 mN·cm or higher. The inner flat tube may have only the hair treating agent sealed therein, and the hair inserter may be inserted into the inner flat tube together with the hair bundle.

The sixth embodiment of the hair holder according to the present invention is described in detail with reference to the drawings.

Figure 8A:
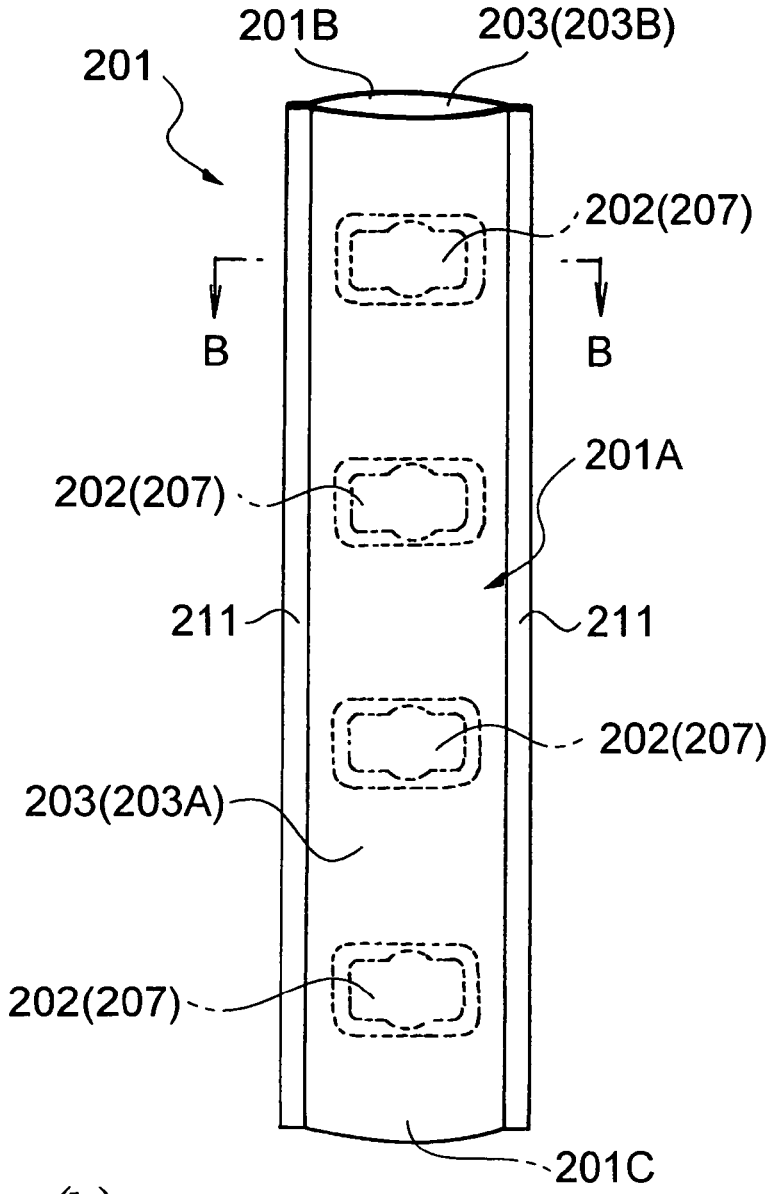
FIG. 8(*a*) is a schematic front view of a hair holder according to a sixth embodiment.
Figure 8B:
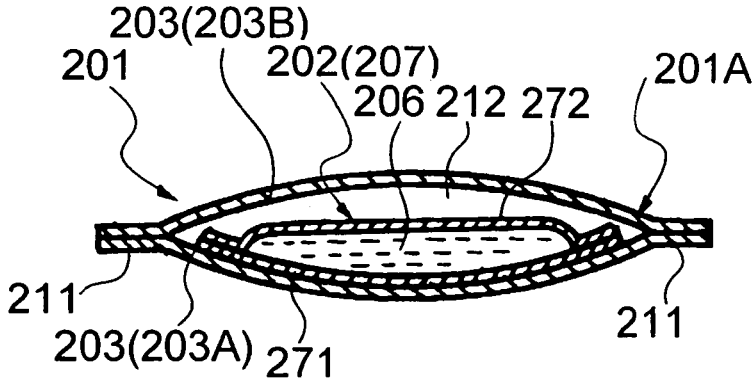

As illustrated in FIGS. 8(*a*) and 8(*b*), the hair holder 201 of the sixth embodiment is composed of two hair holding sheets 203 (203A and 203B) by which a hair bundle 209 (see FIG. 10(*d*)) is kept in a prescribed shape. A plurality of agent packets 202 in which a hair treating agent is enclosed are attached on a side of one of the hair holding sheets 203 (203A).

The structure of the hair holder 201 of the sixth embodiment will be described concretely.

As illustrated in FIGS. 8(*a*) and 8(*b*), according to the hair holder 201 of the present embodiment, a flat tube 201A is composed of two hair holding sheets 203 (203A and 203B). The two hair holding sheets 203A and 203B are heat sealed along their both sides 211 to form the flat tube 201A with its one end 201B and the other end 201C open. The flat tube 201A has a hollow 212 and sealed agent packets 202 in its inside. A hair bundle 209 is inserted through the hollow 212. The flat tube 201A is rolled to roll up a hair bundle 209 in the hollow 212 and keep the hair bundle 209 in a prescribed shape.

The reference numeral 203 is referred to in describing an element common to the two hair holding sheets, while the reference numerals 203A and 203B are used in describing an element different between the two sheets.

Materials to compose the hair holding sheet 203 include nonwoven fabric, woven fabric, and film. Among these materials, film is preferable in terms of flexibility and productivity.

When the hair treating agent is a hair dye, the hair holding sheet 203 is preferably impermeable to the hair treating agent (hereinafter referred to as an impermeable sheet). The impermeable sheet prevents the hair treating agent from oozing to the outer side of the flat tube 210A thereby preventing the hair treating agent from adhering to the operator or operatee while the hair treating agent is being supplied to the hair bundle in the hollow of the flat tube 201A. The impermeable sheet may be a single layer or a laminate of an impermeable layer and a hair treating agent permeable layer.

In this particular embodiment, an impermeable polyethylene film is used as the hair holding sheet 203.

The hair holding sheet 203 preferably has a Taber stiffness of 0.2 to 20 mN·m. With the Taber stiffness falling within the preferred range, the hair holding sheets 203 can be rolled up together with a hair bundle with improved operationality, and the hair bundle can be held in shape satisfactorily without the aid of a stiffener (a rigid member that might be attached to the hair holding sheet along the longitudinal centerline).

The sealed agent packet 202 is described below.

In the present embodiment, a plurality of sealed agent packets 202 having a hair treating agent sealed therein are provided on one of the hair holding sheets, i.e., the hair holding sheet 203A as shown in FIGS. 8(*a*), 8(*b*), and 9. In more detail, four sealed agent packets 202 are attached to the inner side of the flat tube 201A defined by the hair holding sheet 203A at equal spacing in the longitudinal direction.

The sealed agent packet 202 used in the sixth embodiment is composed of an agent-containing bag 207 which is separated from the hair holding sheet 203. The agent-containing bag 207 is formed by joining a base sheet 271 and a concave film 272 having a recess 273 in the thickness direction as illustrated in FIGS. 8(*b*) and 9.

As depicted in FIGS. 8(*b*) and 9, the base sheet 271, a base of the agent-containing bag 207, is a rectangle with four rounded corners. The base sheet 271 of the agent-containing bag 207 can be of various materials that are bondable with the concave film 272 to make the agent-containing bag 207. Examples of such materials include films of various resins, such as polyethylene, polypropylene, nylon, and polyethylene terephthalate, laminates of these resin films, and films of these resins having an inorganic material vacuum-deposited thereon. The base sheet 271 preferably has a thickness of 30 to 300 μm. In this particular embodiment, a double layer film (thickness: 100 μm) composed of a silica-deposited polyethylene film and an ethylene vinyl acetate film is used as a base sheet 271.

The concave film 272 is partially joined with the base sheet 271 to make the agent-containing bag 207 as illustrated in FIGS. 8(*b*) and 9. The concave film 272 has formed in the central part thereof a recess 273 in which a hair treating agent is sealed. The recess 273 is surrounded by a flange 274.

Figure 9:
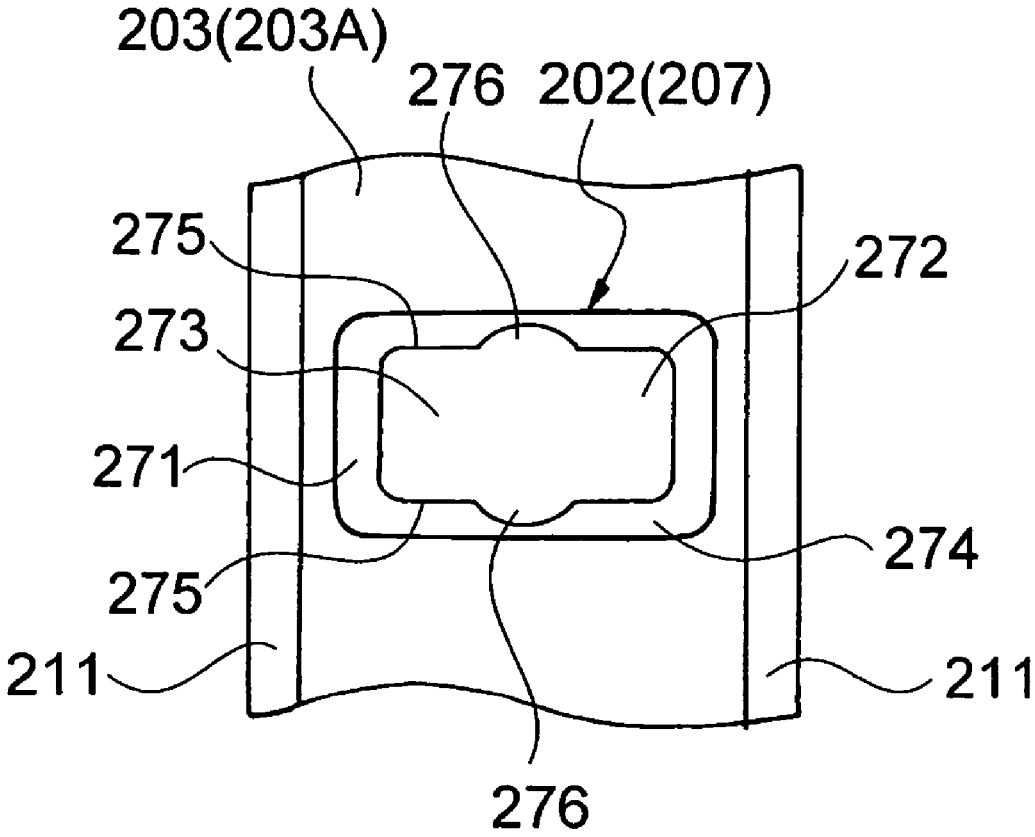
FIG. 9 is an enlarged fragmentary view of a sealed agent packet looking from the inside of a flat tube of the hair holder shown in FIG. 8(*a*).
Figure 10A:
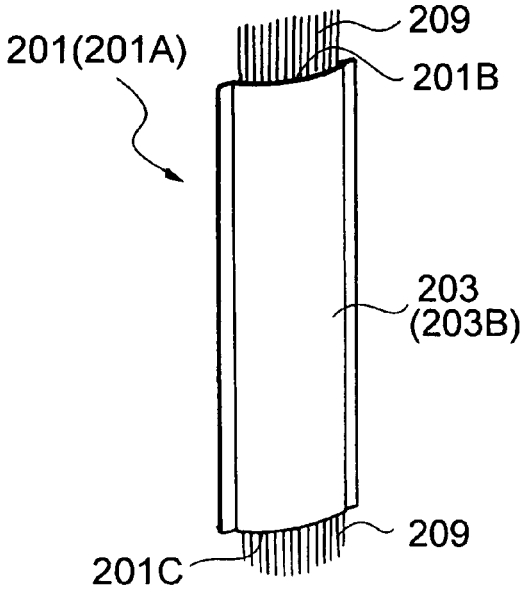
FIG. 10(*a*) is a perspective view of the hair holder of FIG. 8(*a*), illustrating the procedure of rolling up a hair bundle in a mode of use.
Figure 10B:
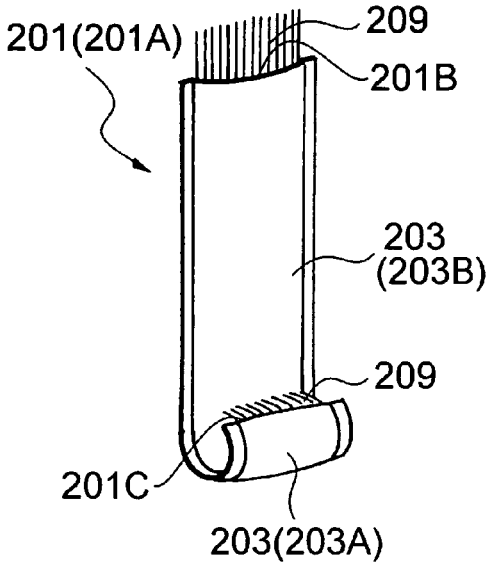
Figure 10C:
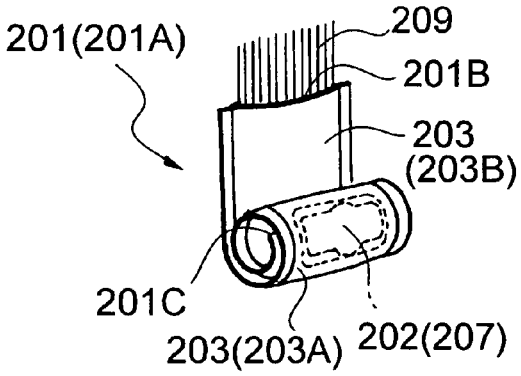
Figure 10D:
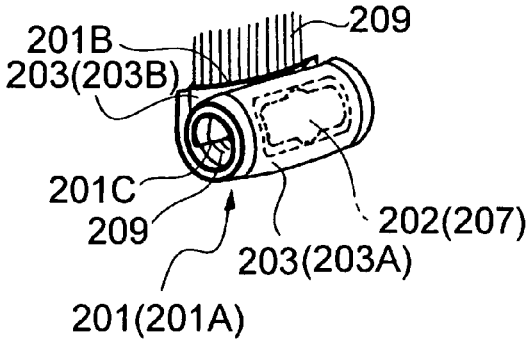

As shown in FIG. 9, the recess 273 has a protrusion 276 at the center of each longer side toward the longer sides of the flange 274.

The protrusion 276 is preferably protuberant in the rolling up direction of the hair holder 201. The flange 274 is narrowed at the protrusions 276. That is, the flange 274 has weak seal strength at the protrusions 276. With pressure applied to the sealed agent packet 202, the stress is concentrated at the protrusions 276. As a result, the sealed agent packets 202 break at the protrusions 276 so that the hair treating agent is fed to the hair bundle always from the protrusions 276. That is, the supply position of the hair treating agent to hairs is fixed.

With regard to the concave film 272, various materials which are capable of forming the agent-containing bag 207 by bonding with the base sheet 271 may be used. Examples of such materials include films of various resins, such as polyethylene, polypropylene, nylon, and polyethylene terephthalate, laminates of these resin films, and films of these resins having an inorganic material vacuum-deposited thereon. The concave film 272 preferably has a thickness of 30 to 500 μm. In the present embodiment, the concave film 272 is a four-layered film (thickness: 150 μm) of polyethylene/ethylene-vinyl alcohol copolymer/polyethylene/ethylene-vinyl acetate copolymer.

The concave film 272 is formed by, for example, vacuum forming using a mold having the shape of the recess 273.

As illustrated in FIGS. 8(*b*) and 9, the base sheet 271 of the agent-containing bag 207 is bonded to the inner surface of the hair holding sheet 203A. The means for bonding the agent-containing bag 207 and the hair holding sheet 203A is not particularly limited. An adhesive or heat fusion can be used.

With regard to the materials to form the sealed agent packet 202 (i.e., the base sheet 271 and the concave film 272 in the present embodiment), the materials which have oxygen barrier properties (JIS K7126) of 100 cc/($m^2$·day)/atm or less and a water vapor barrier properties (JIS Z0208) of 100 g/($m^2$·day) or less are preferable to secure storage stability of the hair treating agent.

A hair treating agent is sealed in the agent-containing bag 207. The concave film 272 is joined to the base sheet 271 at the flange 274 and a hair treating agent is sealed in the inside of the recess 273.

When the base sheet 271 or the concave film 272 is pressed, the pressing pressure destroys the seal between the base sheet 271 and the concave film 272 and thus interconnects the inside and the outside of the agent-containing bag 207.

When the agent-containing bag 207 is broken to release the hair treating agent, the breaking strength under pressure of the agent-containing bag is preferably 0.5 to 10 N.

The number, the volume, and the spacing of the sealed agent packets 202 (the agent-containing bags 207 in the sixth embodiment) are selected appropriately depending on the amount and the kind of the hair treating agent required for a hair treatment, the timing of breaking the packets 202, the pressure required to break the packets 202, and the like. For example, the number of the sealed agent packets 202 per hair holder is 2 to 30; the volume of the individual packets 202 is 1 to 10 ml; and the spacing of arranging the packets 202 is 2 to 10 cm.

The hair treating agent is not particularly limited. Examples of the hair treating agent include a permanent waving solution (one pack type), a hair-care preparation, a hair styling preparation, and a hair dye. To accelerate migration of the hair treating agent by capillarity or diffusion between the hair holding sheet and the hair bundle, the viscosity of the hair treating agent is preferably low, specifically 200 mPa·s or lower.

In case of using a hair treating agent such as a one-pack type permanent waving solution which needs rinsing while the hair bundle is in a rolled state, either one of the two hair holding sheets may be made of a material permeable to the hair treating agent.

An embodiment of the hair treating method according to the present invention will be illustrated by referring to FIGS. 10(*a*) through 10(*d*). This hair treating method represents a mode of use of the hair holder 201 of the sixth embodiment.

As illustrated in FIGS. 10(*a*) to 10(*d*), the hair treating method of the present invention includes the step of rolling up a hair bundle 209 by using the hair holder 201 shown in FIG. 8(*a*). The hair bundle 209 is inserted through the hair holder 201 and rolled up. Pressure is applied to the sealed agent packets 202 to break the sealed agent packets 202. The hair treating agent is released from the packets 202 and it is supplied to the hair bundle 209.

The hair treating method of the present embodiment will be described more specifically.

As illustrated in FIG. 10(*a*), the hair bundle 209 is inserted through the flat tube 201A from its one end 201B into the hollow 212 (see FIG. 8(*b*)) until the tip of the hair bundle 209 sticks out of the opening at the other end 201C. A hair inserter (a tool for leading a hair bundle through a flat tube, not shown here) may be used to guide the hair bundle 209 into the hollow 212. In some cases, the tip of the hair bundle 209 does not need to stick out of the opening at the other end 201C.

As illustrated in FIGS. 10(*b*) to 10(*d*), the flat tube 201A is rolled up together with the hair bundle 209. As depicted in FIGS. 10(*c*) and 10(*d*), the hair holding sheet 203A having the sealed agent packets 202 (agent-containing bags 207) attached thereto faces outwardly. In the present embodiment, the sealed agent packets 202 do not break before rolling because of little pressure applied thereto. Considering that the sealed agent packets 202 should be broken by pressure application during or after rolling up, it is recommended to use a curling rod (not shown) to roll up the hair bundle.

As illustrated in FIG. 10(*d*), after the hair bundle 209 is rolled up, pressure is applied to the sealed agent packets 202. The manner of applying pressure to the sealed agent packets 202 is not particularly restricted. The pressure will be supplied to the roll of the flat tube 201A by pushing with fingers or by grasping with palms.

By the pressure above, the hair treating agent 206 in each of the sealed agent packets 202 (the agent-containing bags 207) is made to flow primarily toward to the protrusions 276 so that the stress is concentrated at the protrusions 276. The seal between the base sheet 271 and the concave film 272 is separated at the narrowed parts of the flange 274. The hair treating agent flows out and it is supplied to the hair bundle 209.

In this state, the hair bundle 209 is allowed to stand for a prescribed period of time, e.g., about 15 minutes, meanwhile the hair treating agent is uniformly distributed throughout the hair bundle 209.

Thereafter, the hair bundle is lightly rinsed, again allowed to stand for a prescribed time, e.g., about 15 minutes. The hair bundle is then freed from the hair holder 201 and thoroughly washed.

According to the hair holder of the present invention and the above-described embodiment of the hair treating method of the present invention, the hair treating agent is prevented from leaking or oozing out, the amount of the hair treating agent required for accomplishing an intended hair treatment is secured, and an adequate amount of the hair treating agent can be migrated smoothly to the rolled up hair bundle 209 and supplied uniformly to the hair bundle 209 since a plurality of sealed agent packets 202 having a hair treating agent sealed therein are provided on a side of the hair holding sheet 203A.

Particularly because the hair treating agent is sealed in the sealed agent packets 202, the hair treating agent is securely retained on the hair holding sheet 203A until pressure is imposed to the sealed agent packets 202 to break the packets 202. In other words, the hair treating agent can be supplied to the hair bundle 209 by applying such a pressure to break the sealed agent packets 202 whenever the hair treating agent is needed to use.

Since there are a plurality of the sealed agent packets 202 arranged in the length direction of the hair holding sheet 203, the supply of the hair treating agent to the hair bundle 209 is uniform in the length direction of the hair bundle 209.

Additionally, it is possible to re-insert the hair bundle 209 before the hair treating agent is supplied to the hair bundle.

Yet another embodiment (seventh embodiment) of the hair holder according to the present invention is described with reference to the accompanying drawings.

Figure 11A:
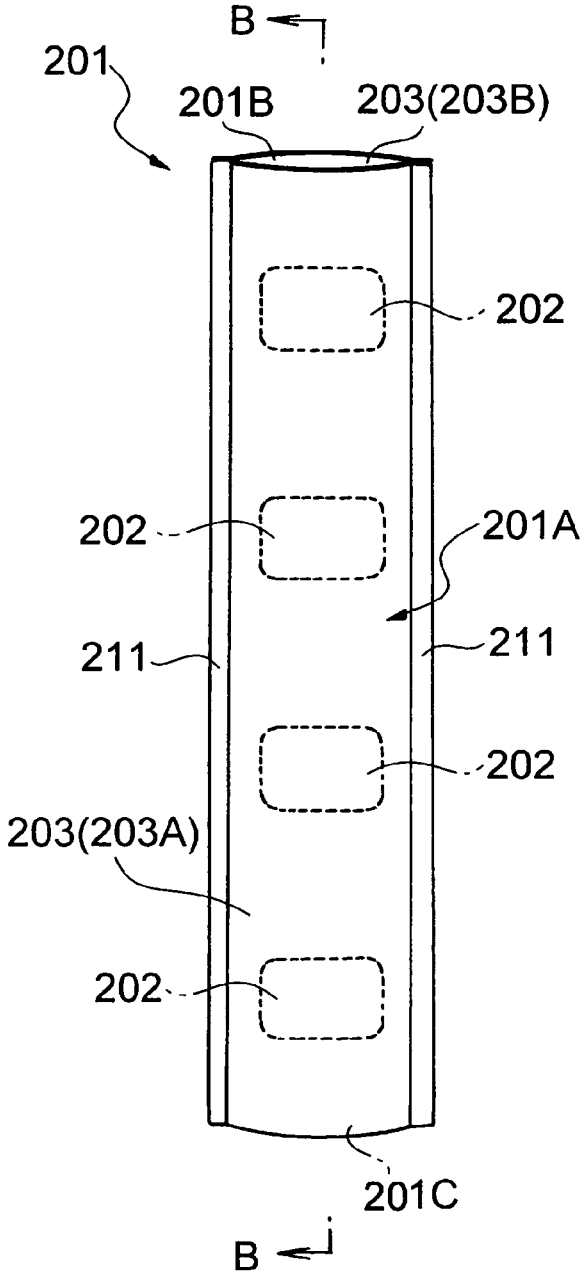
FIG. 11(*a*) is a schematic front view of a hair holder according to a seventh embodiment.
Figure 11B:
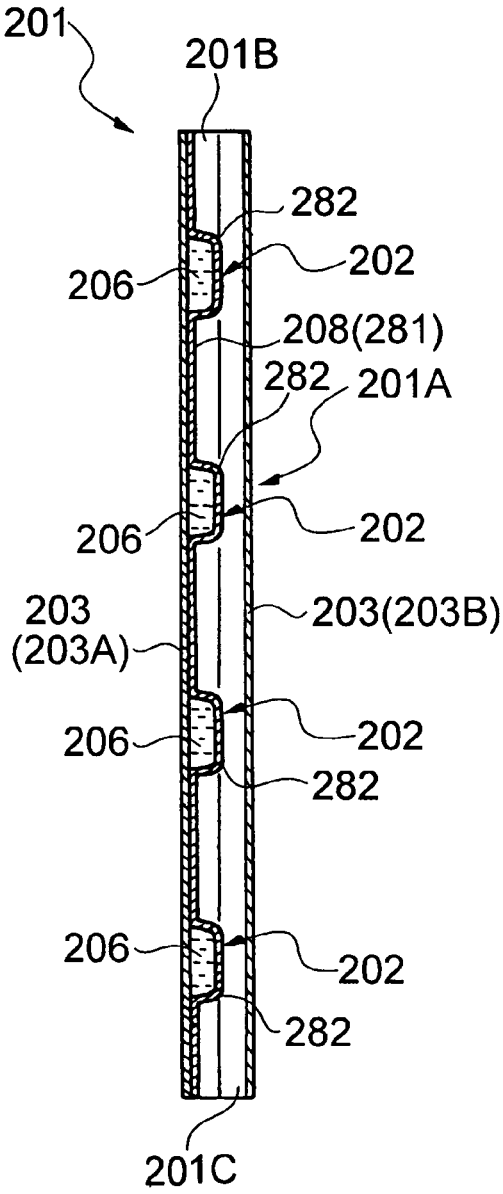
Figure 12:
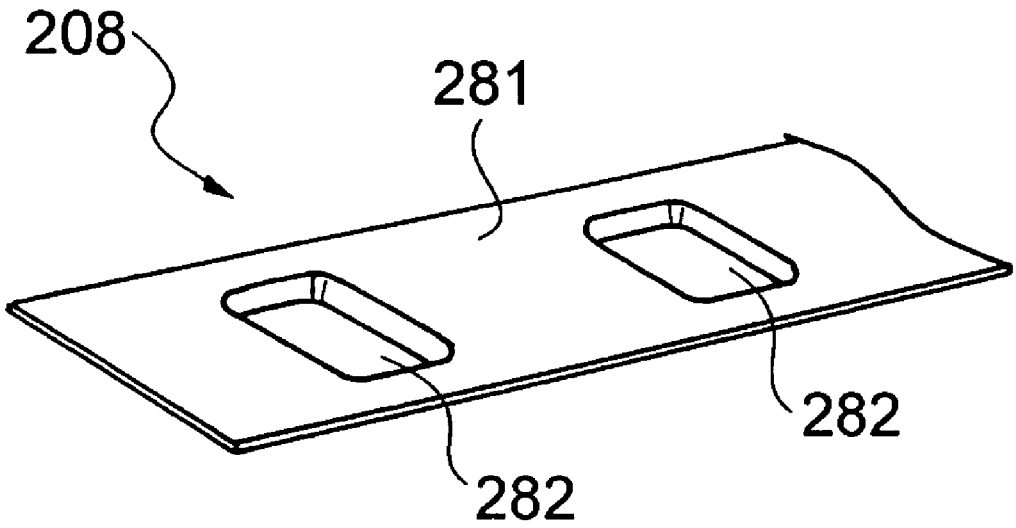
FIG. 12 is a perspective view illustrating a packet-forming sheet used in the hair holder of FIG. 11(*a*).

As illustrated in FIGS. 11(*a*) and 11(*b*), in the hair holder 201 of the seventh embodiment, the sealed agent packets 202 is formed of a packet-forming sheet 208 and one of the hair holding sheet 203, i.e., the hair holding sheet 203A.

As illustrated in FIGS. 11(*b*) and 12, the packet forming sheet 208 is superposed on the inner side of the hair holding sheet 203A to form the sealed agent packets 202. The packet forming sheet 208 is as long as the hair holding sheet 203A and narrower than the hair holding sheet 203A by the both side portions 211 heat sealed.

The packet forming sheet 208 has four recesses 282 which are filled with a hair treating agent. The other part of the packet forming sheet 208 is a flat portion 281. The shape of the recesses 282 is nearly a rectangular parallelepiped and they are arrayed by equal spaces in the length direction of the hair holding sheet 203A.

The packet forming sheet 208 can be formed, e.g., by thermoforming such as blister forming.

The hair holder 201 (flat tube 201A) of the seventh embodiment is produced, for example, as follows.

A hair treating agent is put in the recesses 282 of the packet forming sheet 208, and the flat portion 281 of the packet forming sheet 208 is combined with the hair holding sheet 203A to provide the hair holding sheet 203A with a plurality of sealed agent packets 202. In short, the hair treating agent is blister packaged in between the packet forming sheet 208 and the hair holding sheet 203A to form a plurality of sealed agent packets 202.

Two hair holding sheets 203A and 203B are joined with the sealed agent packets 202 inside and both side edges 211 are heat sealed to obtain the hair holder 201 (flat tube 201A) of the seventh embodiment.

Recommended ranges of the number, the volume, and the spacing of the sealed agent packets 202 are the same as those for the sixth embodiment.

The action and effect of the seventh embodiment are the same as those of the sixth embodiment. The difference from the sixth embodiment consists in the mode of breaking the sealed agent packets 202 and releasing the hair treating agent as explained below.

In the seventh embodiment, the packets 202 are designed to be broken by forming the recesses 282 of a brittle and easily breakable material. Examples of such easily breakable materials include polystyrene, polyacrylate, and polyethylene. In this particular embodiment, polystyrene (thickness: 200 μm) is used as a packet forming sheet 208.

The breakability of the sealed agent packets 282 may be improved by forming a straight or curved groove in the recesses 282.

The present invention is not limited to the sixth and the seventh embodiments, and various modifications can be made thereto.

The cross-section of the tube forming the hair holder according to the present invention is not limited to a flattened elliptic shape and may have, for example, a nearly circular shape. The tube is not limited to the one formed by joining two hair holding sheets along their both side edges and may be a tube formed by longitudinally folding a single hair holding sheet into halves. The tube may be formed of three or more hair holding sheets.

The hair holder of the present invention is not limited to a tube and may be a non-tubular sheet. Such a sheet-shaped hair holder is simple in structure and is preferably used in applications where adhesion of a hair treating agent to an operator is not so problematical, for example, when a hair bundle is treated with a hair-care preparation. A hair bundle is placed on the side of the hair holding sheet where the sealed agent packets are provided, and the hair holding sheet is rolled up with the hair bundle inside. In this case, a dry hair bundle is more easily handled than a wet hair bundle.

The sealed agent packets can be broken by methods other than those described above. The methods include that the sealed agent packets are made of a thin and weak material such as polyethylene (PE) and the packets are broken by poking with an edged tool such as a knife or a needle, the sealed agent packets equipped with a lid are formed and the packets are broken by removing lid.

The sealed agent packets can be provided on the inner side of one or both of the two hair holding sheets which form the flat tube. They may be provided on the outer side of the tube.

The sealed agent packets do not need to be equally spaced. For example, they may be provided on the surface of the hair holding sheet in a zig-zag pattern or at random.

The sealed agent packets in the sixth embodiment may be formed by pouch packaging a hair treating agent.

The tube may have wound therearound a curling thread for rolling a hair bundle in a prescribed shape and retaining the shape.

The timing of breaking the sealed agent packets to release the hair treating agent is not limited. The packets can be broken after rolling up the hair bundle, before or during rolling up the hair bundle.

Where the hair holder is a flat tube, the flat tube may be rolled up with its hair holding sheet having the sealed agent packets facing inwardly.

The hair holder according to the present invention is not limited to the foregoing embodiments, and various changes and modifications can be made therein without departing from the spirit and scope thereof. The elements of the aforementioned embodiments are interchangeable between the embodiments without departing from the spirit and scope of the present invention.

INDUSTRIAL APPLICABILITY

According to the present invention, a hair bundle is held in a hair holder having a hair treating agent integrated with a sheet of which the network structure is hardly deformable and which has at least a certain stiffness. Therefore, the hair holder prevents the hair treating agent from leaking before being used in a hair treatment to retain the amount of the hair treating agent required for the hair treatment. Where a hair bundle is held in a hair holder having a hair treating agent integrated with a sheet having at least a certain water retention, the hair treating agent is smoothly migrated and uniformly supplied to the hair bundle.

According to the present invention, in particular, the hair treating agent does not leak or ooze out in the stage of rolling up the sheet containing the hair treating agent. Upon pressure application to the sheet, the hair treating agent is released from the sheet, smoothly migrated and uniformly supplied to the hair bundle.

According to the present invention, a sheet which holds a hair bundle in a prescribed shape is impermeable, and a high viscous hair treating agent is applied to the impermeable sheet. As a result, the hair treating agent can be uniformly retained on the sheet and uniformly supplied to a hair bundle.

According to the present invention, a requisite amount of a hair treating agent for achieving a hair treatment is integrated with a sheet and is securely retained on the sheet without leaking. Thus, a sufficient amount of the hair treating agent can be uniformly supplied to a hair bundle. According to the present invention, the hair holder is easy to handle and operate. Additionally, the present invention allows for applying a hair treating agent only to the portion of hair that is to be treated (i.e., only the hair bundle held in the hair holder) without adhering the hair treating agent to the other part of hair that should be left untreated and without soiling the clothing and the skin of an operator and an operatee. The present invention also allows for re-inserting a hair bundle.

The invention claimed is:

1. A hair holder comprising:

two hair holding sheets configured to hold a hair bundle in a prescribed shape, the hair holding sheets comprising a flat tube with two sides and a hollow therein, the hollow being configured to have a hair bundle inserted therethrough, wherein at least one of the hair holding sheets has a Taber stiffness of 0.2 mN·m or higher, wherein at least one of the hair holding sheets has provided on a side thereof a plurality of sealed agent packets including a hair treating agent sealed therein, the sealed packets each including a protrusion within the packet, which protrusion is a portion weaker in seal strength than a remainder of the respective sealed packet.

2. The hair holder according to claim 1, wherein the flat tube has an agent-impermeable layer comprising a material impermeable to the hair treating agent formed on part of, or the whole of, the outer surface thereof.

3. The hair holder according to claim 1, wherein at least one of the hair holding sheets is an agent-coated sheet having a hair treating agent having a viscosity of 100 mPa·s or higher applied to the inner side thereof and being impermeable to the hair treating agent.

4. The hair holder according to claim 3, wherein the hair treating agent is supported by an agent-supporting layer.

5. The hair holder according to claim 1, wherein agent packets are arranged in the hollow.

6. The hair holder according to claim 1, wherein the sealed agent packets are agent-containing bags formed separately from the hair holding sheets.

7. The hair holder according to claim 1, wherein the sealed agent packets are formed by a packet-forming sheet and the side of the at least one of the hair holding sheets, the packet-forming sheet has a plurality of recesses which are concave in the thickness direction and in which the hair treating agent is sealed.

8. The hair holder according to claim 5, wherein the sealed agent packets are agent-containing bags formed separately from the hair holding sheets.

9. The hair holder according to claim 5, wherein the sealed agent packets are formed by a packet-forming sheet and the side of the at least one of the hair holding sheets, the packet-forming sheet has a plurality of recesses which are concave in the thickness direction and in which the hair treating agent is sealed.

10. The hair holder according to claim 1, wherein the flat tube comprises two sheets sealed together at side edges.

11. A hair treating method comprising providing the hair holder according to claim 1, placing or inserting a hair bundle on or through the hair holder, rolling up the hair holder together with the hair bundle, and applying pressure to the sealed agent packets before, during or after the rolling up to break the packets thereby releasing the hair treating agent out of the packets and supplying the hair treating agent to the hair.

12. A hair treating method comprising:

providing hair holding sheets configured to hold a hair bundle in a prescribed shape, at least one of the hair holding sheets being a sheet having a Taber stiffness of 0.2 mN·m or higher, wherein the hair holding sheets comprise a flat tube including two sides and a hollow configured to have a hair bundle inserted therethrough and at least one of the hair holding sheets includes, on a side thereof, a plurality of sealed agent packets including a hair treating agent sealed therein, the sealed packets each including a protrusion within the packet, which protrusion is a portion weaker in seal strength than a remainder of the respective sealed packet, the method further including releasing the hair treating agent from the packets via the respective protrusions and applying the hair treating agent to the at least one of the hair holding sheets to provide a hair treatment to the hair bundle inserted in the hollow.

13. A hair holder comprising:

one or more hair holding sheets for holding a hair bundle in a prescribed shape, at least one of the hair holding sheets retaining a hair treating agent such that the hair treating agent is integrated therewith, wherein at least one of the hair holding sheets is an agent-coated sheet having a hair treating agent having a viscosity of 100 mPa·s or higher applied to the inner side thereof and being impermeable to the hair treating agent, wherein the hair holder comprises a flat tube having two sides, one side of the flat tube being formed of the agent-coated sheet, and the other side being formed of an agent-permeable sheet permeable to the hair treating agent, the hair holder further comprising a protective sheet impermeable to the hair treating agent inserted between the agent-coated sheet and the agent-permeable sheet to provide a hollow for inserting a hair bundle between the agent-permeable sheet and the protective sheet.

14. The hair holder according to claim 13, wherein the hair treating agent is supported by an agent-supporting layer.

15. The hair holder according to claim 13, wherein the flat tube comprises two sheets sealed together at side edges.

16. A hair holder comprising:

one or more hair holding sheets to hold a hair bundle in a prescribed shape, at least one of the hair holding sheets retaining a hair treating agent such that the hair treating agent is integrated therewith;

an outer flat tube and an inner flat tube inserted through the outer flat tube, the outer flat tube being formed of two sheets for holding a hair bundle in a prescribed shape, the inner flat tube being formed of two other hair holding sheets, at least one of the two other hair holding sheets being an agent-coated sheet, and the inner flat tube including a hollow through which a hair bundle is adapted to be inserted, wherein at least one of the hair holding sheets is an agent-impregnated sheet having a Taber stiffness of 0.2 mN·m or higher and a water retention of 0.03 g/cm$^2$ or more and impregnated with the hair treating agent, and wherein at least one of the hair holding sheets is the agent-coated sheet having a hair treating agent having a viscosity of 100 mPa·s or higher applied to the inner side thereof and being impermeable to the hair treating agent.

17. The hair holder according to claim 16, further comprising a hair inserter configured to lead a hair bundle into the hollow of the inner flat tube, the hair inserter being sealed in the inner flat tube together with the hair treating agent.

18. The hair holder according to claim 17, wherein the end of the inner flat tube is configured to expose the end of the hair inserter.

19. A hair holder comprising:

one or more hair holding sheets for holding a hair bundle in a prescribed shape, at least one of the hair holding sheets retaining a hair treating agent such that the hair treating agent is integrated therewith, wherein at least one of the hair holding sheets is an agent-impregnated sheet having a Taber stiffness of 0.2 mN·m or higher and a water retention of 0.03 g/cm$^2$ or more and impregnated with the hair treating agent, wherein at least one of the hair holding sheets is an agent-coated sheet having a hair treating agent having a viscosity of 100 mPa·s or higher applied to the inner side thereof and being impermeable to the hair treating agent, wherein the hair treating agent is supported by an agent-supporting layer, and wherein the hair holder comprises a flat tube having including two sides, one side of the flat tube being formed of the agent-coated sheet, and the other side being formed of an agent-permeable sheet permeable to the hair treating agent, the hair holder further comprising a protective sheet impermeable to the hair treating agent inserted between the agent-coated sheet and the agent-permeable sheet to provide a hollow for inserting a hair bundle between the agent-permeable sheet and the protective sheet.

20. A hair holder comprising:

one or more hair holding sheets for holding a hair bundle in a prescribed shape, at least one of the hair holding sheets retaining a hair treating agent such that the hair treating agent is integrated therewith, wherein at least one of the hair holding sheets is an agent-impregnated sheet having a Taber stiffness of 0.2 mN·m or higher and a water retention of 0.03 g/cm$^2$ or more and impregnated with the hair treating agent, wherein at least one of the hair holding sheets is an agent-coated sheet having a hair treating agent having a viscosity of 100 mPa·s or higher applied to the inner side thereof and being impermeable to the hair treating agent, and wherein the hair treating agent is supported by an agent-supporting layer, the hair holder further comprising an outer flat tube and an inner flat tube inserted through the outer flat tube, the outer flat tube being formed of two sheets for holding a hair bundle in a prescribed shape, the inner flat tube being formed of two other hair holding sheets, at least one of the two other hair holding sheets being the agent-coated sheet, and the inner flat tube having a hollow through which a hair bundle is adapted to be inserted.

* * * * *